US008888406B2

(12) United States Patent
Keaton et al.

(10) Patent No.: US 8,888,406 B2
(45) Date of Patent: Nov. 18, 2014

(54) WEIGHTED BAG

(71) Applicant: Mid-American Gunite, Inc, Newport, MI (US)

(72) Inventors: Donald E. Keaton, Saint Clairsville, OH (US); Robert G. Harte, Ashland, KY (US)

(73) Assignee: Mid-American Gunite, Inc., Newport, MI (US)

( * ) Notice: Subject to any disclaimer, the term of this patent is extended or adjusted under 35 U.S.C. 154(b) by 0 days.

(21) Appl. No.: 13/762,674

(22) Filed: Feb. 8, 2013

(65) Prior Publication Data

US 2013/0223940 A1 Aug. 29, 2013

Related U.S. Application Data

(60) Provisional application No. 61/603,255, filed on Feb. 25, 2012.

(51) Int. Cl.
*E02B 3/12* (2006.01)

(52) U.S. Cl.
CPC ..... *E02B 3/127* (2013.01)
USPC ..... 405/16; 405/18; 405/111; 405/184.4; 383/123

(58) Field of Classification Search
CPC ..... E02B 3/12; E02B 3/127
USPC ..... 405/16, 17, 18, 107, 111, 114, 184.4; 383/123, 124, 125, 126
See application file for complete search history.

(56) References Cited

U.S. PATENT DOCUMENTS

| | | | | |
|---|---|---|---|---|
| 1,383,809 | A * | 7/1921 | Howard | 383/125 |
| 3,237,845 | A * | 3/1966 | Piazze | 383/125 |
| 4,940,364 | A * | 7/1990 | Dlugosz | 405/19 |
| 5,669,732 | A * | 9/1997 | Truitt | 405/18 |
| 5,845,995 | A * | 12/1998 | Starlinger Huemer | 383/125 |
| 6,641,329 | B1 * | 11/2003 | Clement | 405/115 |
| 7,074,305 | B2 * | 7/2006 | Connors | 405/184.4 |
| 2002/0090265 | A1 | 7/2002 | Merten | |
| 2005/0123221 | A1 * | 6/2005 | Wang | 383/107 |
| 2007/0009327 | A1 * | 1/2007 | Sanguinetti | 405/115 |

(Continued)

FOREIGN PATENT DOCUMENTS

| | | | |
|---|---|---|---|
| DE | 3925856 | A1 | 2/1991 |
| DE | 10248374 | A1 | 5/2004 |

(Continued)

OTHER PUBLICATIONS

PCT Search Report mailed May 10, 2013 for corresponding PCT application No. PCT/US2013/026112.

*Primary Examiner* — Frederick L Lagman
(74) *Attorney, Agent, or Firm* — Quinn Law Group, PLLC.

(57) ABSTRACT

A weighted bag includes a filler material contained by a sealed bag configured to be substantially impermeable to fluids. The sealed bag may include a generally tubular bag body made from a polyvinyl chloride (PVC) coated polymer-based textile where the tubular bag body is formed by hot air welding and the bag is sealed using sealing tape applied and bonded at each end of the tubular bag body. The weighted bag may be recovered after use and recycled for reuse in a subsequent installation. The filler material may include a slag, a slag-based material and/or low iron fines which may be residual material from the steel or iron producing industries.

20 Claims, 3 Drawing Sheets

(56) References Cited

U.S. PATENT DOCUMENTS

| | | | | |
|---|---|---|---|---|
| 2008/0019780 | A1* | 1/2008 | Hastings | 405/302.4 |
| 2010/0086355 | A1* | 4/2010 | Komiya | 405/24 |
| 2011/0286687 | A1* | 11/2011 | Pienaar et al. | 383/37 |

FOREIGN PATENT DOCUMENTS

| | | | | | |
|---|---|---|---|---|---|
| EP | 0172088 | | * | 2/1986 | E02B 3/12 |
| GB | 190712444 | A | | 10/1907 | |
| JP | 2003293345 | A | * | 10/2003 | E02B 3/04 |

* cited by examiner

WEIGHTED BAG

CROSS-REFERENCE TO RELATED APPLICATIONS

This application claims priority to and the benefit of U.S. Provisional Patent Application No. 61/603,255, filed on Feb. 25, 2012, which is hereby incorporated by reference in its entirety.

TECHNICAL FIELD

The present invention relates to a sealable bag filled with a material.

BACKGROUND

Sand bags are used in a variety of applications including fluid containment in forming containment levees or other similar structures to retain the flow of a fluid, in military applications to form barrier structures such as bunkers, and in construction applications to provide a support structure for pipelines. Sand bags may also be used in weight applications, such as ballast applications or other applications requiring an applied load.

Often sand bags are formed by manually filling a mesh-type bag with sand and manually closing the bag. The bag may be made of a saturable or water (fluid) permeable material, such as a polypropylene-based or burlap material and/or closed using a method which permits ingression or leakage of water (or other fluid being contained) into the bag, such that the fluid wets the bag material and the sand and is retained by the sand bag substantially increasing the weight of the bag. Sand bags may deteriorate or break due to breakdown of the bag material due to the increased stress of the wetted sand, deterioration from exposure to ultraviolet (UV) light, exposure to chemicals in the fluid being contained, etc. Closing methods to close the sand bag after filling may allow leakage of sand from the bag or may be non-permanent such that the closure does not provide a long term sealing method to contain the sand in the bag. Breakdown and deterioration of the sand bags may weaken the barrier or containment structure formed by the sand bags, allow spillage of the sand from the bag which may necessitate clean-up actions, and prevent recovery of the sand bags for storage, recycling, and/or reuse.

SUMMARY

A weighted bag including a filler material contained by a sealed bag and a method of forming the weighted bag are provided herein. The sealed bag is configured to be substantially impermeable to fluids. In a first example configuration, the sealed bag includes a generally tubular bag body made from a polyvinyl chloride (PVC) coated polymer-based textile, wherein the tubular bag body is formed by hot air welding and the bag is sealed using sealing tape applied and bonded at each end of the generally tubular bag body. The weighted bag is configured to be resistant to deterioration due to UV exposure, such that the weighted bag may be characterized by an extended life and increased durability as compared with a conventional sand bag. The weighted bag remains sealed during use, including during extended time in use, such that leakage of the filler material is prevented. The weighted bag described herein may be recycled, e.g., recovered after use and reused in a subsequent installation, thus providing savings in materials, labor, and environmental impact.

The filler material contained in the weighted material may be a slag or slag-based material which may be residual material from the steel or iron producing industries. In one example, the slag-based material is substantially comprised of low iron fines which may remain after extraction of an iron rich portion of the slag material. Using the low iron slag material as the filler material in the weighted bag provides a beneficial use of the low iron slag, generally considered a residual material. Using the low iron slag material as the filler material may have other advantages. For example, in the event of leakage, the slag material may be substantially environmentally neutral. The slag material may be configured with a basic composition such that it may be usable to neutralize acidic fluids or spillage being contained by the weighted bags in the event of inadvertent leakage of the filler material from the bag.

The above features and other features and advantages of the present teachings are readily apparent from the following detailed description of the best modes for carrying out the present teachings when taken in connection with the accompanying drawings.

DETAILED DESCRIPTION

Figure 1:
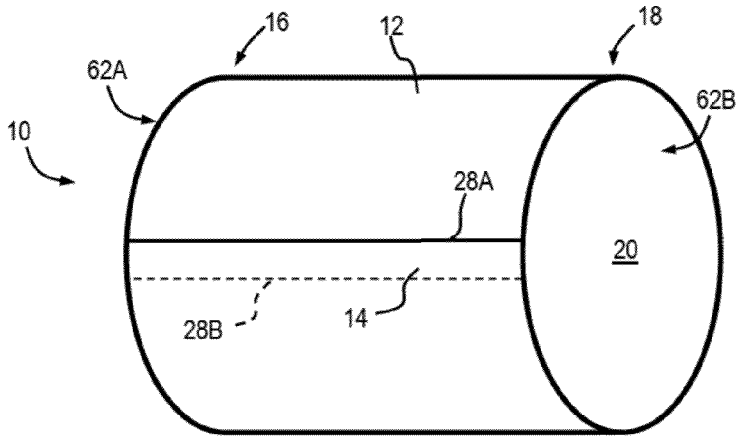
FIG. 1 is a schematic perspective side view of a tube portion formed during formation of a weighted bag.

Referring to the drawings wherein like reference numbers represent like components throughout the several figures, the elements shown in FIGS. 1-11 are not necessarily to scale or proportion. Accordingly, the particular dimensions and applications provided in the drawings presented herein are not to be considered limiting. A weighted bag including a filler material sealed therein and a method of forming the weighted bag are provided herein. In one example, the filler material includes a slag material, which may be a slag, slag-type, slag-based or slag-containing material which may be residual material from the steel and iron producing industry, and may include slag generated in a blast furnace, a converter, a basic oxygen furnace (BOF), or an electric furnace, and/or one or more of the types of slag commonly referred to as blast furnace slag, kish slag, c-scrap slag, desulfurization slag, and/or a combination of these.

Figure 5:
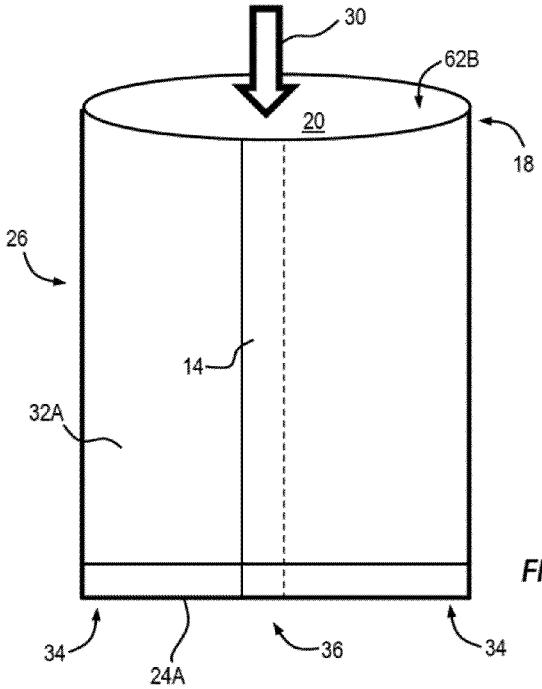
FIG. 5 is a schematic perspective side view of the open-ended bag of FIG. 4 receiving a filler material through an opening defined by the second end of the open-ended bag.
Figure 6:
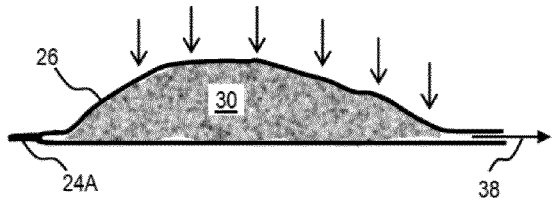
FIG. 6 is a schematic cross-sectional view of the filled open-ended bag of FIG. 5 with excess air removed.
Figure 7:
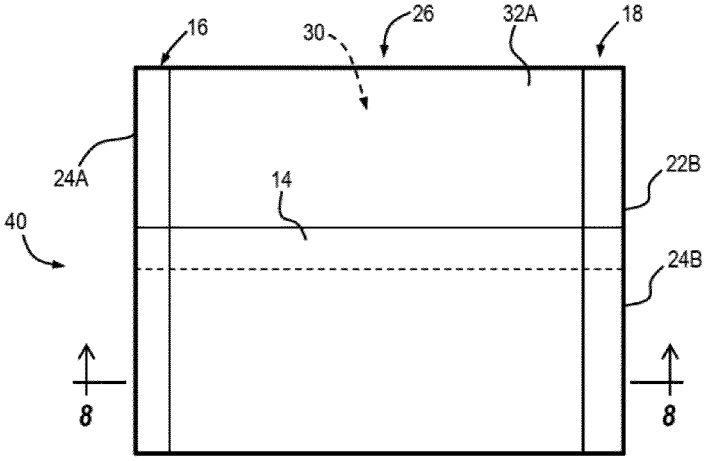
FIG. 7 is a schematic side view of a weighted bag formed by sealing the second end of the open-ended filled bag of FIG. 6.
Figure 8:
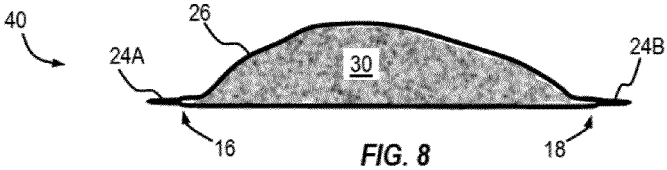
FIG. 8 is a schematic cross-sectional view of the filled bag of FIG. 7 after forming the weighted bag.
Figure 9:
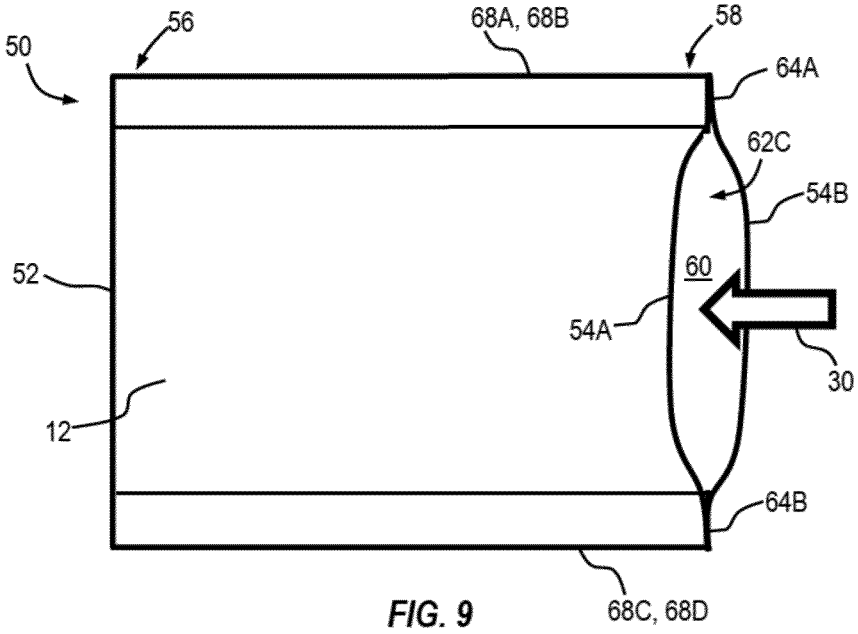
FIG. 9 is schematic perspective side view of another configuration of an open-ended bag.
Figure 10:
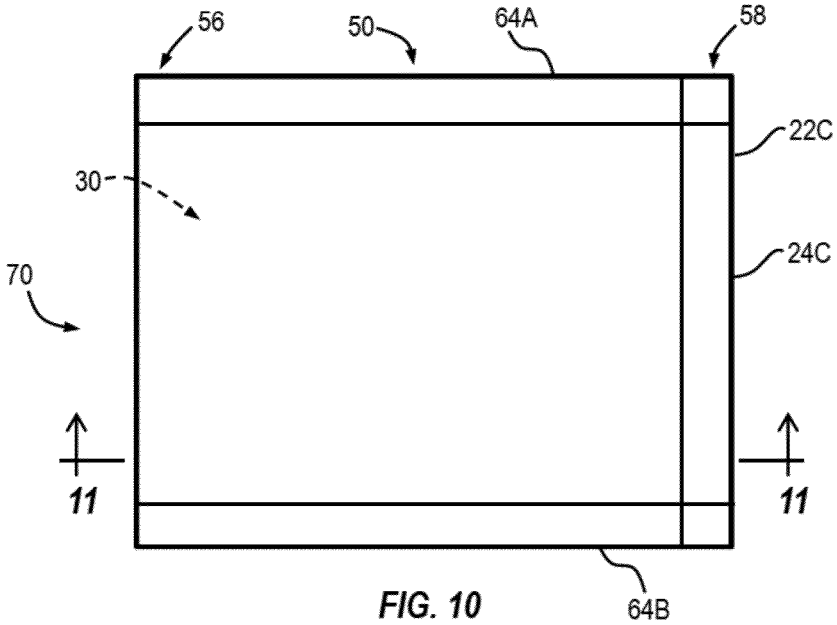
FIG. 10 is a schematic side view of a weighted bag formed by filling the open-ended bag of FIG. 9 with a filler material and sealing a second end of the bag.
Figure 11:
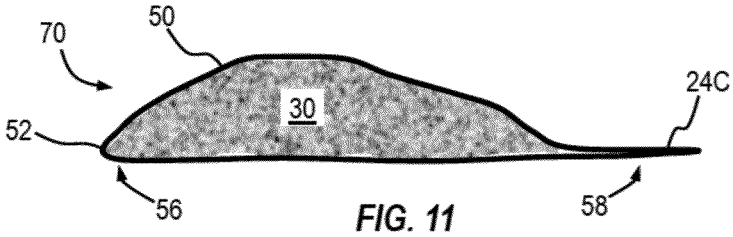
FIG. 11 is a schematic cross-sectional view of the bag of FIG. 9 after bonding the tape to form a sealed weighted bag.

FIGS. 1-8 show a first example configuration of a weighted bag generally indicated at 40 in FIGS. 7-8 and containing a filler material 30, and an exemplary method of forming the weighted bag 40. FIGS. 9-11 show another example configuration and method for forming a weighted bag generally indicated at 70 in FIGS. 10-11 and containing the filler material 30. By way of non-limiting example, the weighted bag 40, 70 may be configured for use in forming a fluid containment structure such as a levee, in a construction or a military application to form a support, barrier or foundation structure, and/or in weighted applications such as ballast, counterweighting, or pressurizing applications.

Referring to FIG. 1, shown is a schematic perspective side view of a tubular portion 10 which is formed, filled with a filler material 30, and sealed as shown in FIGS. 1-8 to form the weighted bag 40 shown in FIGS. 7-8. The tubular portion 10 may be formed from a sheet material 12. The sheet material 12 may be a polymer-based textile which is substantially impermeable to water, e.g., has a low water vapor transmission rate, such that when bonded to form a sealed weighted bag 40, the bag 40 may be characterized as water tight. The sheet material 12 may be characterized by good flexibility with sufficient tensile and tear strength to provide impact strength and adhesion resistance, thermal stability within its operating temperature range, and resistance to deterioration due to environmental and weatherability (UV, ozone, oxygen) attack. The sheet material 12 may be configured to provide a weighted bag 40 which will have an extended usable life as compared with conventional sand bags. For example, the weighted bag 40 may be configured to have a nominal or average expected usable life of 5 years. By extending the usable life of the weighted bag 40, structures formed from the weighted bags 40 may have an increase useful life and/or extended period of stability. For example, using the weighted bags 40 to provide foundational support for pipelines may provide increased positional stability of the pipelines over time, as the weighted bags 40 may not deteriorate, absorb moisture, leak, shift, or become non-compliant at the same rate or magnitude, for example, of conventional sand bags. Similarly, other structures such as levees constructed using the weighted bags 40 may demonstrate extended usable life and improved positional stability relative to comparable structures constructed using conventional sandbags.

The sheet material 12 may include a polymer-based fabric coated with a water resistant material. In a non-limiting example, the sheet material 12 may include a base fabric of polyester, which may be polyester 1000D provided in a fabric weight of 5.5 oz/yd$^2$. The base fabric may be coated with polyvinyl chloride (PVC) and unbalanced coated 60/40 to provide a sheet material 12 with a nominal weight of 18.5 oz/yd$^2$. The PVC coated polyester sheet material 12 may be characterized by a nominal tensile strength of 270×270 lbs/in in the warp and fill direction, a nominal tear strength of 100×90 lbs/in as measured using the single tongue method, an adhesion of 10 lbs/in., a UV resistance rating of UV Protected, and cold crack resistance to −55 deg. F as measured per MIL-C-20696. The example described herein is non-limiting, and other combinations of polyester and PVC coating may be used to provide a sheet material 12 within a weight range of 16-22 oz/yd$^2$.

The sheet material 12 may be characterized by an appearance treatment such as a dye, pigment, coloring, label, or other appearance treatment such that the appearance treatment defines a functional characteristic of the weighted bag 40. For example, the sheet material 12 may be provided in a functional color, such as OSHA (Occupational Safety and Health Administration) orange or OSHA yellow, to enhance visibility of a structure composed of or including the colored weighted bags 40, to provide a cautionary warning to an observer, for example, of a potentially hazardous condition such as retained water or spillage, or to identify the structure as a barrier to a restricted access area such as a construction site or other hazardous site or as a vehicle barrier. The sheet material 12 may be configured with a reflective appearance, for hazard warning or to be light reflecting for increased night time detectability or visibility, as would be suitable for use in construction of a vehicle barrier, for example. In another example, the sheet material 12 may be configured with a camouflage appearance or with a camouflage coloring, such as Desert Tan or Draft Green. A plurality of weighted bags 40 in a combination of camouflage related colors and/or with a camouflage appearance may be used to form a structure having a camouflage appearance for military use or recreational use as hunting camouflage. The sheet material 12 may be configured to be non-reflective, to enhance camouflage capability. The sheet material 12 may be configured with a color, a marking which may be a symbol, text, pattern, or other marking, a label, an embossment, or a combination of these to provide identification and/or traceability of the weighted bag 40. Identification and/or traceability of the weighted bag 40 may be advantageous to establish ownership of recyclable bags, including those which may be owned/used by private entities such as construction organizations for retrieval from and redeployment of the weighted bags 40 at multiple construction sites. Other advantages may be traceability or identification of a weighted bag 40 to a structure or a location within a structure including the weighted bag 40, as a means of determining any change in the formation of the structure, as by, for example, break through flooding in a levee or other containment structure, to expedite location and repair of the containment break.

Continuing with FIG. 1, the sheet material 12 may be provided in a predetermined size and configuration to provide a finished sealed bag 40 in a size and configuration as required for the bag application. The size of the finished weighted bag 40 may be defined by one or more characteristics required to configure a weighted bag 40 appropriate to the application of the bag in use. Characteristics which may define the size of the weighted bag 40, and thereby define the size and/or configuration of the sheet material 12 and tube 10, may include one or more or a combination of the desired total weight of the bag which may be a maximum allowable weight (for example, to meet manual lifting standards), a minimum required weight (for example, for weighting applications or positional stability), a target or controlled weight range (for example, for ballast or counterweight applications), a fill ratio required to provide a bag 40 having a predetermined pack density or pack configuration when used in combination with other bags 40 (for example, for ballistic applications), an overall dimension or surface area corresponding to the application such as a width, length or coverage area, etc. For example, a weighted bag 40 having a sufficiently large surface area to distribute a retaining load over the base plate or base member of a temporary road sign may be preferred in a weight application, to stabilize and retain the road sign in position. In another example, a weighted bag 40 having a relatively smaller surface area may be preferred to provide a targeted load to bonded areas of adjacent members in contact with each other during the curing cycle of the adhesive used to bond the adjacent surfaces to one another, and to avoid loading of the non-bonded portions of the adjacent members where loading of the non-bonded portions is unnecessarily or undesirable.

In one example, the sheet material 12 may be provided in a generally rectangular shape such that opposing edges 28A, 28B may be overlapped and operatively attached to each other to form a generally tubular portion 10. By non-limiting example, the longitudinal length L of the tubular portion 10 may range from approximately 10 to 30 inches and the transverse width W in the flattened configuration shown FIG. 2 may range from approximately 4 to 15 inches. In one example, the sheet material 12 is provided in a generally rectangular shape having a longitudinal length L of approximately 24 inches and a transverse length of approximately 31 inches to provide a tube portion 10 having a longitudinal length L of approximately 12 inches and a transverse width W of approximately 15 inches. The opposing edges 28A, 28B may be joined together by hot air welding, which may also be known as hot gas welding or plastic welding, to provide a sealed joint or longitudinal seam 14. The opposing edges 28A, 28B may be overlapped prior to joining. The example of hot air welding is non-limiting, and other forms of joining, bonding, or adhering the adjacent and/or overlapping edges 28A, 28B to form the sealed longitudinal seam 14 may be used. For example, radio-frequency (RF) welding may be used to form the sealed seam 14. The sealed longitudinal seam 14 is formed such that the longitudinal seam 14 is waterproof, e.g., impermeable by water.

Figure 2:
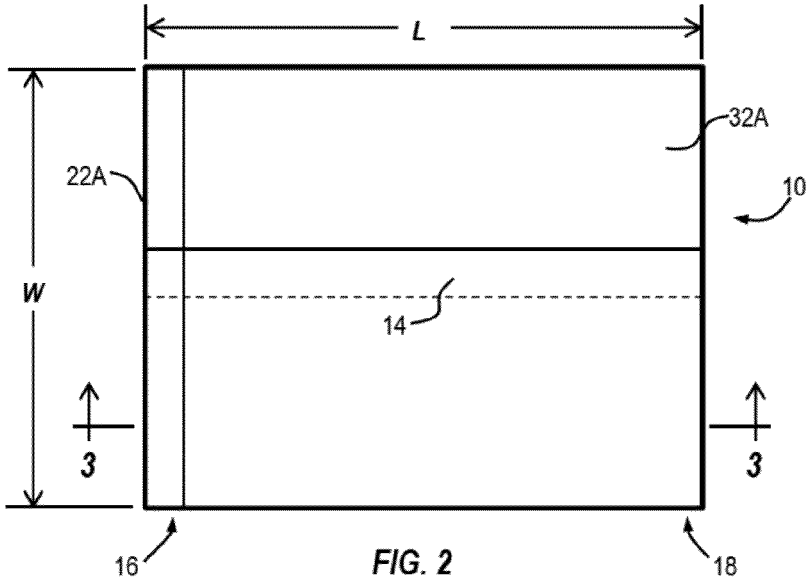
FIG. 2 is a schematic side view of the tube of FIG. 1 including a tape applied to a first end of the tube.
Figure 3:
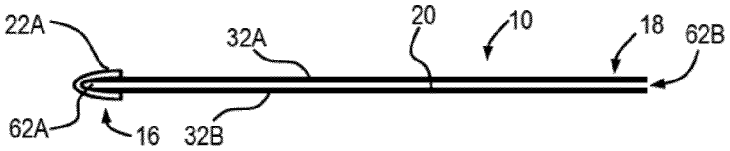
FIG. 3 is a schematic cross-sectional view of the tube and tape of FIG. 2 prior to bonding the tape.

The tube configuration shown in FIG. 1 may provide an advantage of increased burst or split strength, for example, during a dropping impact test of the weighted bag 40, relative to the example configuration shown in FIGS. 9-11, by reducing the number of longitudinal seams to one, configuring the longitudinal seam 14 as an overlapping seam, and/or positioning the longitudinal seam 14 in a central portion of one of the opposing bag surfaces 32A, 32B, where the opposing bag surfaces 32A, 32B are formed by flattening the tubular portion 10 as shown in FIGS. 2-3. Further, when the transverse seam 24A is formed by attaching the seam tape 22A to the edge portion 16, the end of the longitudinal seam 14 is entrapped by the seam tape 22A and further reinforced during welding of the seam tape 22A to the tubular portion 10 to form the transverse seam 24A. As shown in FIG. 5, the transverse seam 24A forms a watertight seal including first and second seal ends 34 and an intermediate seal portion 36. It would be understood that the width of the seam 14, e.g., the width of the overlapping portions of the opposing edges 28A, 28B may be controlled to control the strength of the longitudinal seam 14 by controlling the total bonded or welded area defined by the seam 14. For example, the amount of overlap between the opposing edges 28A, 28B may increased and/or the area of the welded joint may be increased to increase the seam strength of the longitudinal seam 14.

Figure 4:
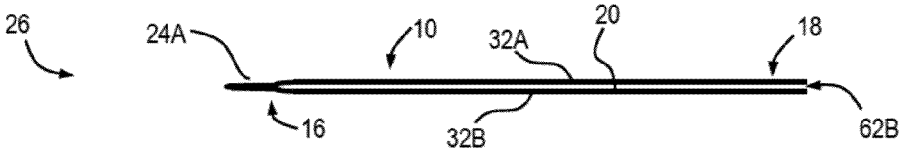
FIG. 4 is a schematic cross-sectional view of the tube and tape of FIG. 2 after bonding the tape to form an open-ended bag.

The generally tubular portion 10 includes opposing end portions 16, 18. The tubular portion 10 defines a hollow central area 20 which is accessible through openings 62A, 62B defined by respective end portions 16, 18 of the tubular portion 10 as shown in FIG. 1. Referring now to FIG. 2, shown is a schematic side view of the tubular portion 10 of FIG. 1 which has been flattened to define the opposing bag surfaces 32A, 32B (see FIGS. 3-4) and to position the longitudinal seam 14 central to the bag surface 32A such that the longitudinal seam 14 is generally centrally located with respect to a length of tape 22A applied to the first end portion 16 of the tubular portion 10, and is entrapped in an intermediate portion 36 of the transverse seam 24A (see FIG. 5). The tape 22A may be configured as a seam tape which may be bonded to the sheet material 12 using a plastic welding method, such as hot air welding, to seal the first end portion 16 of the tubular portion 10 to form the open-ended bag 26 shown in FIGS. 4-6. The tape 22A may include polyester and/or PVC based materials. By example, the tape 22A may be configured as a strip of the sheet material 12. The tape 22A may be applied, as shown in FIGS. 2 and 3, to the flattened tubular portion 10 such that the tape 22A overlaps the opposing bag surfaces 32A, 32B of the tube end portion 16, to enclose the end portion 16 of the tubular portion 10. The tape 22A may be hot air welded to form a first transverse end seam 24A as shown in FIG. 4, thereby sealing the first end portion 16 of the tubular portion 10 to form a water tight seal. The watertight seal formed by seam 24A includes seal ends 34 and an intermediate portion 36 therebetween, formed such that the longitudinal seam 14 is entrapped in and/or operatively affixed to the intermediate portion 36 of the transverse seam 24A. The longitudinal seam 14 may be oriented such that the longitudinal seam 14 is generally perpendicular to the transverse seam 22A. FIG. 4 shows a schematic cross-section view of the open-ended bag 26 including the flattened tubular portion 10 with the first end portion 16 sealably enclosed by the seam 24A after plastic welding the tape 22A to the tubular portion 10. The hollow central area 20 of the open-ended bag 26 remains accessible via the opening 62B defined by the end portion 18 as shown in FIGS. 4 and 5.

Referring now to FIG. 5, shown is a schematic perspective side view of the open-ended bag 26 of FIG. 4. A filler material 30 may be fed into the hollow central area 20 through the opening 62B of the open-ended bag 26. The amount of filler material 30 fed into the hollow area 20 may be controlled to provide a predetermined amount of filler material 30. The predetermined amount may be defined by the end use requirements of the weighted bag 40 in application. For example, the amount of filler material 30 fed into the open-ended bag 26 may be defined by the size of the weighted bag 40 formed therefrom, the volume of the hollow area 20, and/or a desired total weight of the weighted bag 40. For example, the desired total weight of the weighted bag 40 may be controlled to not exceed a maximum weight (for example, to meet manual lifting standards), to meet a minimum weight (for weighting applications or positional stability), or to meet a predetermined weight tolerance required to achieve a fill ratio to provide a bag 40 having a predetermined pack density (for example, for force absorption in a ballistic application) or to provide a predetermined pack configuration when used in combination with other bags 40. The fill ratio may be expressed as a percentage fill of the volume of the hollow area 20, e.g., a percentage of the total volume of the hollow area 20 consumed by the filler material 30 fed into the open ended bag 26. The amount of filler material 30 fed into the hollow area 20 may be controlled by controlling the weight of the filler material 30 fed into the open-ended bag 26, the volume of the filler material 30 fed into the open-ended bag 26, a combination of these, or other factors, such as the flow rate and cycle time of equipment used to feed the filler material 30 into the open-ended bag 26. By way of example, the amount of filler material 30 fed into the hollow area 20 may range in volume from 30 to 80 percent of the total volume of the hollow area 20, e.g., the fill ratio may range between 30 and 80 percent. In one example, the weighted bag 40 is configured such that the amount of filler material 30 by volume is 40 to 70 percent of the total volume of the hollow area 20. In a preferred embodiment, the fill rate is between 50 and 65 percent.

As described previously, the filler material 30 may include a slag material, which may be a slag, slag-type, slag-based, or slag-containing material which may be residual material from the steel and iron producing industry, and may include slag generated in a blast furnace, a converter, a basic oxygen furnace (BOF), or an electric furnace, and/or one or more of the types of slag commonly referred to as blast furnace slag, kish slag, c-scrap slag, desulfurization slag, and/or a combination of these. The filler material 30 may be composed substantially of slag material, e.g., the filler material may include at least 70% slag by weight or at least 70% slag by volume. In one example, the filler material 30 may be composed primarily of slag material, e.g., the filler material may include at least 90% slag as measured by weight or volume. In another example, the filler material 30 may include at least 99% slag material. In one example, the filler material 30 may be a slag material configured as a remainder portion of a slag from which an iron rich portion has been removed, such that the filler material 30 is a low iron material, e.g., a slag aggregate generally having a total iron content of less than 40% by weight and preferably less than 30% by weight.

The filler material 30 may be configured as a fine slag material composed of particles which are less than 40 mesh in size and preferably smaller than 60 mesh in size. The fine particle size of the filler material 30 may contribute to the ability to conform the shape of the weighted bag 40 to other weighted bags 40 in forming a structure such as a spillage or water containment wall or barrier, to maximize the packed density of the structure and minimize and voids or openings, thereby optimizing the structural integrity of the structure and minimizing the permeability of the structure to prevent leakage of the spillage and/or water contained thereby. The weighted bags 40 may be used for hazardous materials (hazmat) containment, where the packed density of containment structures formed using the weighted bags 40 may optimized by compliance of each weighted bag 40 to the adjacent weighted bags 40 forming the containment structure. Additionally, the sealed configuration of the weighted bags 40 may provide advantages related to hazmat containment including impermeability of the weighted bag 40 by the hazardous material being contained. Upon completion of a hazmat containment action, because the filler material 30 is sealably contained in the weighted bag 40 and remains uncontaminated, the exterior surface of the weighted bag 40 may be cleaned of the hazardous material and the bag 40 redeployed for reuse. The particle size of the filler material 30 may be controlled to optimize or maximize the density of the filler material 30, which may be advantageous in some applications such as military applications where the weighted bags 40 may be configured to provide ballistic protection, to absorb shrapnel, blast shock waves, or other incoming impingements, where the increased density of the fine particle filler material 30 increases the absorption, deflection and ballistic resistance of the structure formed by the weighted bags 40.

The slag material may configured to have an iron content which is configured to provide a filler material 30 of a predetermined specified gravity corresponding to a desired volume and weight of filler material 30 to be contained in a weighted bag 40. This may be advantageous in weighted applications where the weighted bag 40 is used, for example, as a counterweight of known weight, in structural weight testing to provide a test load of predetermined value, as a counterweight of known value, etc. The slag material may have an iron content sufficiently high to provide a higher weight to volume ratio for counterweight or force loading applications where in space limited applications, for example, in ballast applications including using weighted bags 40 for vehicle traction control, for balancing boats to prevent porpoising, to counterbalance tug boat loading, for disposable ballast on gas balloons, etc. The slag material may be configured with a predetermined iron content using separation methods to segregate a slag portion including slag particles which in aggregate have the predetermined iron content using, for example, magnetic separation methods or other separation methods such as air separation which may rely on specific gravity characteristics of the slag particles. The ability to selectively configure a filler material 30 of a predetermined density or specific gravity which may be varied by segregation of a portion of a slag material to provide a filler material 30 having a predetermined iron content may provide advantages as compared to conventional filler materials used to fill conventional sand bags, such as sand, which have a relatively constant density.

The slag material may be dried prior to being fed as filler material 30 into the open-ended bag 26, for purposes of reducing surface moisture of the slag material and to minimize moisture retained in the filler material 30 enclosed in the weighted bag 40 after sealing. By minimizing moisture in the enclosed filler material 30, mold growth in the filler material 30 may be prevented or mitigated, which may contributed to extending the useful life of the weighted bag 40.

In a non-limiting example, the filler material 30 may be a slag-based material dried to have less than 1% surface moisture. The slag material may include particles ranging in size from +6 mesh to −200 mesh. The particle size and/or iron content of the slag material may be controlled to provide filler material 30 having a bulk density of approximately 140 lbs/$ft^3$. The chemistry of the slag material may be configured to provide filler material 30 having a neutralizing characteristic with a base to acid ratio ranging from 2 to 4. For example, the slag material may have a calcium oxide (CaO) content of 25% nominally. In some applications, the slag material may be intentionally released from the weighted bags 40 to counteract or neutralize an acidic spillage condition, for example, providing an advantage in use as compared to a substantially silica containing sand bag.

Referring now to FIG. 6, a schematic cross-sectional view of the filled open-ended bag 26 of FIG. 5 is shown. After filling, the open-ended bag 26 is manipulated such that excess air 38 is removed from the open-ended bag 26 prior to sealing as shown in FIGS. 7-8. Removal of the excess air 38 may be accomplished by compressing the open-ended bag 26 in a manner that the air 38 is evacuated without spilling or displacing the filler material 30 from the open-ended bag 26. Other techniques may be used, including vacuum assisted methods of excess air removal. Removal of the excess air optimizes the density and compliance of the weighted bag 40, thereby enhancing the pack density achievable when stacking weighed bags 40 in contact with one another in closest pack arrangement to optimize structure integrity and density and minimize structure leakage or voids of structures formed from or including weighted bags 40.

Referring now to FIG. 7, shown is a schematic side view of a weighed bag 40 formed by sealing the open-ended filled bag 26 of FIG. 6 with a seam tape 22B applied to a second end portion 18 of the tubular portion 10. As described previously related to FIGS. 2-4, the tape 22B may be configured as a seam tape which may be a strip of the sheet material 12 applied and bonded to the sheet material 12 using a plastic welding method such as hot air welding to seal the opening 62B defined by the second end portion 18 to form a transverse seam 24B and thereby form the sealed weighted bag 40 shown in FIGS. 7-8. The tape 22B may include polyester and/or PVC based materials, and may be configured as a strip or band of the sheet material 12. The tape 22B may be applied to the second end portion 18 using a method and configuration similar to or substantially the same as shown in and described for FIGS. 2 and 3 related to the application of the tape 22A to the first end portion 16, wherein the seam tape 22B may be applied to overlap the top and bottom surfaces of the abutting portions of the second end portion 18, thereby enclosing the second end portion 18 of the tube portion 10. The tape 22B may be hot air welded to form the transverse seam 24B as shown in FIGS. 7-8, thereby sealing the second end portion 18 of the weighted bag 40 to form a water tight seal, and sealably enclosing the filler material 30 in the weighted bag 40. The transverse seam 24B may be formed such that the longitudinal seam 14 is entrapped in and sealed in contact with the intermediate portion 36 of the transverse seam 24B (as shown for transverse seam 24A in FIG. 5) for increased burst strength of the weighted bag 40. The transverse seam 24B is configured to be impermeable to water, such that the combination of seams 14, 24A and 24B seal the weighted bag 40 to sealably enclose the filler material 30 therein.

In another example, the transverse seam 24B may be folded over (not shown) and the transverse seam 24B may be hot air welded or plastic welded to the sheet material 12 adjacent to the folded over portion, to reinforce the seal formed by the transverse seam 24B at the second end portion 18 of the weighted bag 40.

FIG. 9 is schematic perspective side view of another configuration of an open-ended bag generally indicated at 50. A sheet material 12, which may be a substantially water impermeable material such as a PVC coated polyester material as described related to FIGS. 1-8, is provided in a predetermined size and configuration to provide a finished sealed bag 70 in the size and configuration required for the bag application. As described previously, the sheet material 12 may be characterized by an appearance treatment to provide a functional characteristic of the weighted bag 50, such as color, labeling, reflectivity, camouflage, identification, traceability, etc. As shown in FIG. 9, the sheet material 12 folded along a transverse fold line 52 such that transverse edges 54A and 54B are adjacent each other and a first end portion 56 of the open-ended bag 50 is enclosed. Adjacent and opposing edges 68A, 68B are plastic welded, using hot air welding or another plastic welding method such as radio frequency (RF) welding, to form a first longitudinal side seam 64A. Similarly, adjacent and opposing edges 68C, 68D are plastic welded, using hot air welding or another plastic welding method such as RF welding, to form a longitudinal side seam 64B, thereby forming the open-ended bag 50 and defining a hollow area 60 accessible via an opening 62C defined by a second end portion 58 of the bag 50. The longitudinal side seams 64A and 64B are formed as water tight seams. Each of the longitudinal side seams 64A and 64B may be folded over (not shown) and plastic welded to the adjacent sheet material 12 to further seal, reinforce and/or strength the longitudinal side seams 64A, 64B. As previously described for transverse seams 24A and 24B, a strip of the sheet material 12 may be applied to each of the longitudinal sides and welded to form the longitudinal side seams 64A, 64B.

As shown in FIG. 9, the open-ended bag 50 is filled with filler material 30 of a predetermined amount as required by the bag application and/or defined by one or more determining factors as described previously related to FIG. 5. The filler material 30 may be a slag-based material as described previously. The filled open-ended bag 50 is manipulated by a method similar to that described related to FIG. 6 to remove excess air from the open-ended bag 50 prior to sealing the second end portion 58 as shown in FIGS. 10 and 11.

As shown in FIGS. 10 and 11 and similar to the method described for bag 40 and FIGS. 7-8, a seam tape 22C is applied to the second end portion 58 of the open-ended bag 50 and bonded by hot air welding or similar method to form the water tight transverse seam 24C, thereby forming the weighted bag 70 and sealably containing the filler material 30 enclosed therein. Alternatively, the transverse end seam 24C may be formed using one of the methods previously described for forming the longitudinal side seams 64A, 64B, by plastic welding the adjacent edge portions 54A, 54B to one another to form the transverse seam 24C, or by plastic welding the adjacent edge portions 54A, 54B to one another, folding over the welded portion, and plastic welding the welded portion to the material sheet 12 to form the transverse seam 24C.

The examples shown in FIGS. 1-11 of a weighted bag 40, 70 including a slag-based filler material 30 are not intended to be limiting. Other configurations of the weighted bag 40, 70 are possible. Non-permeable polymeric materials other than PVC coated materials may be used to form the bag. Bonding methods may be used to directly bond abutting or adjacent end or edge portions of the sheet material 12 to form the longitudinal seams 14, 64A, 64B and/or the transverse seams 24A, 24B, 24C. Other applications of the weighted bags described herein are possible. For example, the weighted bags may be used in soundproofing and/or insulating applications, or to stabilize soil erosion areas.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A weighted bag comprising:

a polymeric bag configured to be substantially impermeable by water;

a filler material sealably contained by the bag;

wherein the filler material is a slag-based material characterized as low iron fines having a total iron content of less than 40% by weight;

the bag having a generally tubular bag body flattened to define opposing rectangular bag surfaces sealed at first and second ends of the bag body by a transverse end seam;

the bag body including only a singular longitudinal seam extending the length of the bag; and wherein the tubular bag body is flattened such that the singular longitudinal seam is located centrally in one of the opposing rectangular bag surfaces and intersects an intermediate portion of each of the transverse end seams.

2. The weighted bag of claim 1, wherein the bag is configured of a polymer based textile having a water vapor transmission rate sufficiently low such that the polymer based textile is substantially impermeable by water.

3. The weighted bag of claim 2, wherein the polymer based textile is configured to be resistant to deterioration due to exposure to at least one of ozone and ultraviolet light.

4. The weighted bag of claim 2, wherein the bag is made of a material having a nominal tear strength of 100×90 pounds per inch.

5. The weighted bag of claim 1, wherein the bag is configured of PVC coated polyester.

6. The weighted bag of claim 1, wherein the slag-based material has a particle size of less than 40 mesh.

7. The weighted bag of claim 1, wherein the bag includes:

a sealing tape operatively affixed to the bag body to enclose an end portion of the bag body and to form a watertight seal.

8. The weighted bag of claim 1, wherein the bag is characterized by a camouflage appearance.

9. The weighted bag of claim 1, wherein the bag is characterized by a reflective appearance.

10. The weighted bag of claim 1, wherein the slag material has a basic composition.

11. The weighted bag of claim 1, wherein the longitudinal seam is overlapped and plastic welded.

12. A method for forming a weighted bag, the method comprising:

providing a polymeric sheet material configured to be substantially impermeable by water;

sealably joining a first pair of opposing sides of the sheet material with only a singular longitudinal seam to form a tubular body, the tubular body comprising a first end opening and a second end opening;

flattening the tubular body to define opposing generally rectangular sides;

wherein the singular longitudinal seam is positioned centrally in one of the rectangular sides;

sealably joining the opposing rectangular sides of the sheet material to seal a first end opening to form a transverse end seal such that the singular longitudinal seam intersects an intermediate portion of the transverse end seam and to define a bag configured to receive filler material;

filling the bag with filler material, wherein the filler material is a slag-based material characterized as low iron fines having a total iron content of less than 40% by weight;

sealably joining the opposing rectangular sides of the sheet material to sealably contain the filler material.

13. The method of claim 12, further comprising:

manipulating the bag to remove excess air from the bag prior to sealably joining the third pair of opposing sides of the sheet material.

14. The method of claim 12, further comprising:

drying the filler material to less than one percent surface moisture prior to filling the bag with the filler material.

15. The method of claim 12, wherein sealably joining at least one pair of the first pair, the second pair, and the third pair of opposing sides includes overlapping the opposing sides and hot air plastic welding the at least one pair of overlapping opposing sides to form the longitudinal seam.

16. The method of claim 15, further comprising:

applying a seam tape to the at least one pair of opposing sides prior to hot air welding the at least one pair of opposing sides.

17. The method of claim 12, further comprising:

controlling the amount of filler material fed into the bag such that the weighted bag is characterized by a predetermined fill ratio.

18. A weighted bag comprising:

a bag configured of a polymer based textile having a water vapor transmission rate sufficiently low such that the polymer based textile is substantially impermeable by water;

a slag-based material sealably contained by the bag;

the slag-based material having a specific gravity of approximately 140 lbs/ft$^3$ and comprising at least 70% slag-based material fines; and wherein the bag:

includes a generally tubular bag body enclosed at each of an opposing first and second end by a transverse seal;

each transverse seal having a first seal end, a second seal end, and an intermediate portion therebetween;

the generally tubular bag body defining no more than one longitudinal seam;

the longitudinal seam operatively affixed to the intermediate portion of each of the first and second transverse seals.

19. The weighted bag of claim 18, wherein the polymer based textile is configured to be resistant to deterioration due to exposure to at least one of ozone and ultraviolet light.

20. The weighted bag of claim 18, wherein the bag is slag-based material has a particle size of less than 40 mesh.

* * * * *